US005452864A

United States Patent [19]

Alford et al.

[11] Patent Number: 5,452,864

[45] Date of Patent: Sep. 26, 1995

[54] ELECTRO-MECHANICAL ROLL CONTROL APPARATUS AND METHOD

[75] Inventors: Robert L. Alford, Excelsior; John G. Rupert, Mahtomedi, both of Minn.

[73] Assignee: Alliant Techsystems Inc., Hopkins, Minn.

[21] Appl. No.: 221,358

[22] Filed: Mar. 31, 1994

[51] Int. Cl.[6] ..... F42B 10/02; F42B 10/24; F42B 10/14

[52] U.S. Cl. ..... 244/3.23; 244/3.24

[58] Field of Search ..... 244/3.21, 3.23, 244/3.24, 3.25, 3.26, 3.27, 3.28, 3.29, 3.3

[56] References Cited

U.S. PATENT DOCUMENTS

| | | | |
|---|---|---|---|
| H905 | 4/1991 | Rottenberg | 244/3.28 |
| H932 | 7/1991 | Ng | 244/3.23 |
| 2,920,568 | 1/1960 | Rabinow | 102/70.2 |
| 2,990,776 | 7/1961 | Clarke | 102/70.2 |
| 3,067,681 | 12/1962 | Beman | 102/49 |
| 3,111,088 | 11/1963 | Fisk | 102/51 |
| 3,125,027 | 3/1964 | Stoller | 102/70.2 |
| 4,076,187 | 2/1978 | Metz | 244/3.23 |
| 4,188,816 | 2/1980 | Mairson | 73/1 D |
| 4,222,272 | 9/1980 | Mairson | 73/517 R |
| 4,373,688 | 2/1983 | Topliffe | 244/3.24 |
| 4,438,893 | 3/1984 | Sands et al. | 244/3.21 |
| 4,512,537 | 4/1985 | Sebestyen et al. | 244/3.21 |
| 4,568,039 | 2/1986 | Smith et al. | 244/3.15 |
| 4,664,338 | 5/1987 | Steuer et al. | 244/3.28 |
| 4,791,573 | 12/1988 | Zemany et al. | 364/454 |
| 4,867,393 | 9/1989 | Faupell et al. | 244/3.22 |
| 4,898,342 | 2/1990 | Kranz et al. | 244/3.21 |
| 4,964,593 | 10/1990 | Kranz | 244/3.24 |
| 5,164,538 | 11/1992 | McClain, III | 102/517 |

*Primary Examiner*—Charles T. Jordan
*Assistant Examiner*—Christopher K. Montgomery
*Attorney, Agent, or Firm*—Merchant, Gould, Smith, Edell, Welter & Schmidt

[57] ABSTRACT

An apparatus and method for controlling roll of a projectile is disclosed. The projectile includes two sections decoupled about a roll axis. The front section includes a stator and the rear section includes a rotor and a static spin imparting member. The spin rate of the projectile is controlled by utilizing the rotor and stator in combination as a generator to brake the spin or as a motor to establish spin.

19 Claims, 7 Drawing Sheets

FIG. 3
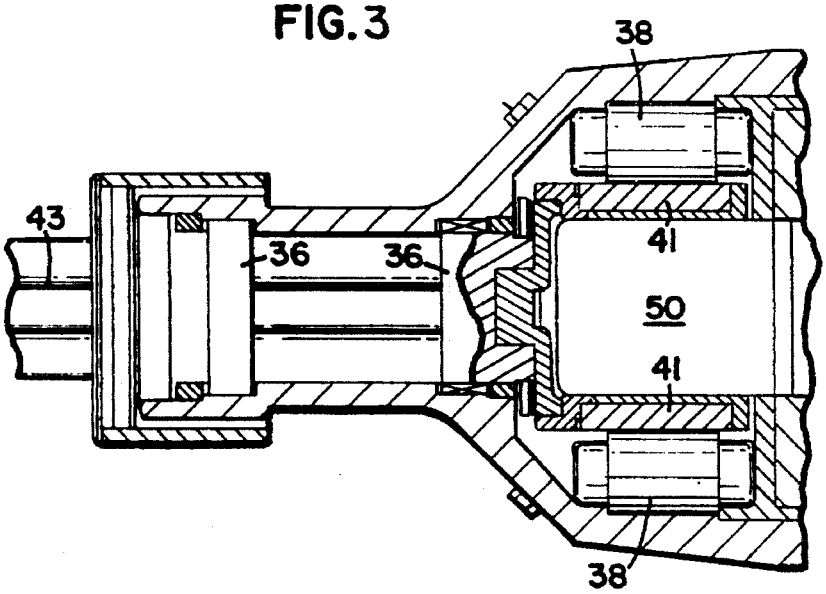
FIG. 8
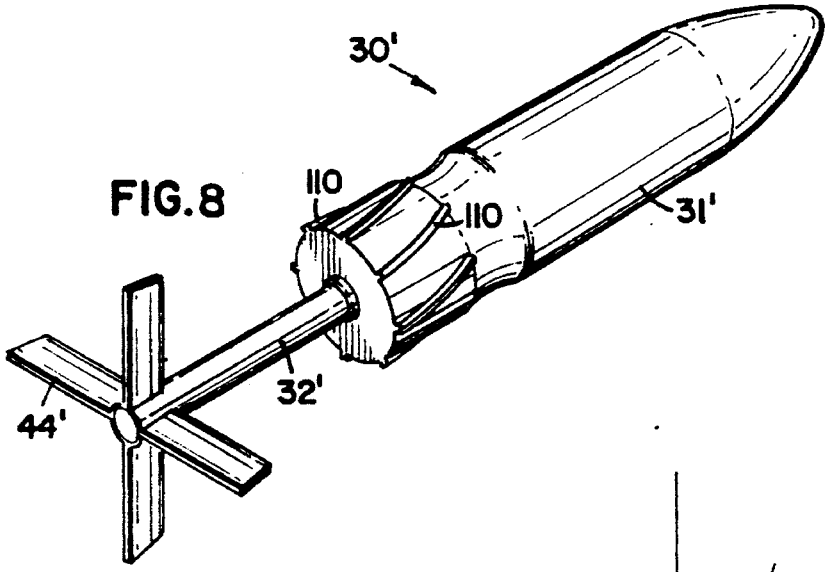
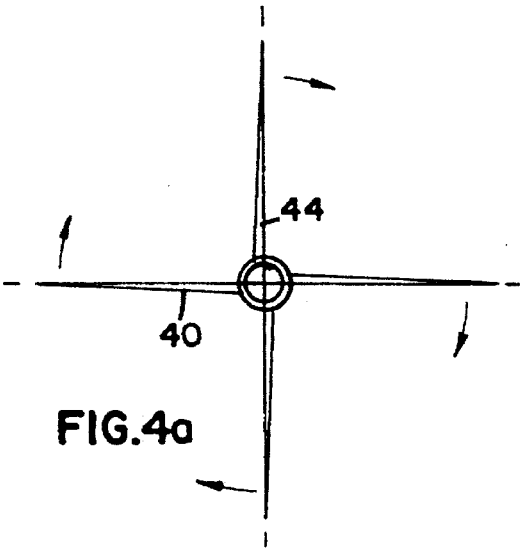
FIG. 4a
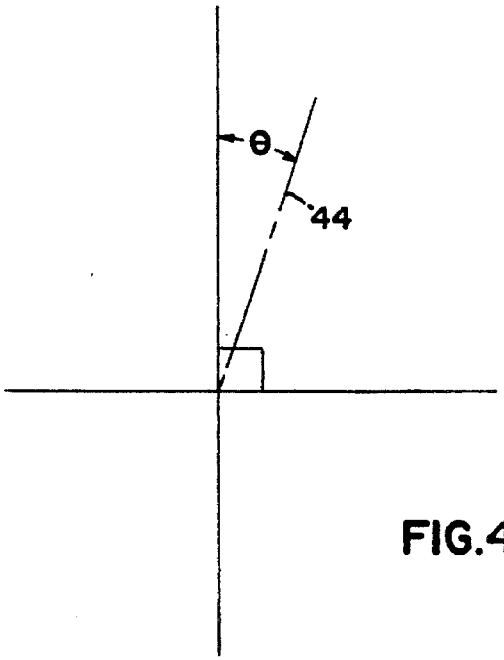
FIG. 4b

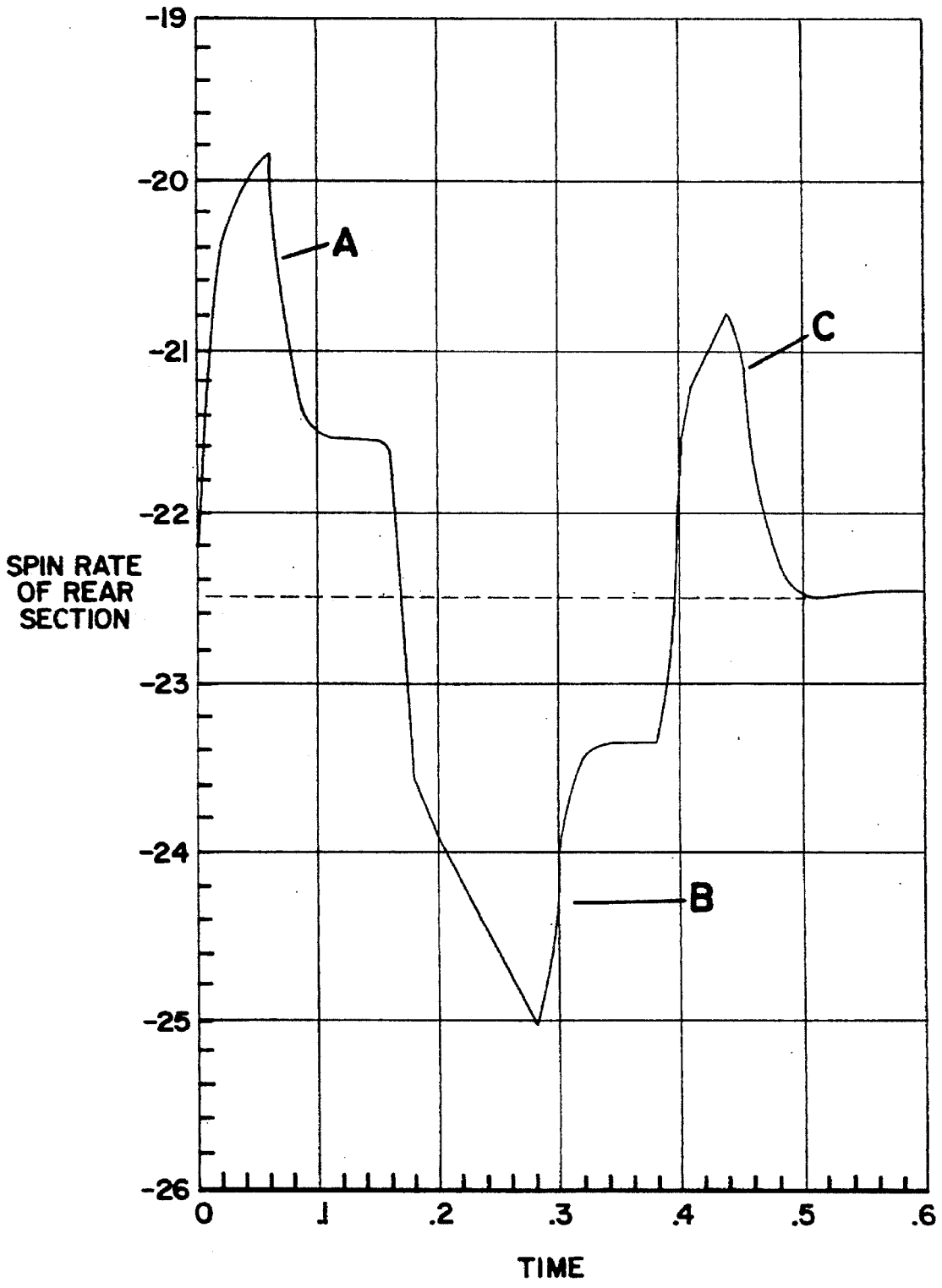
-19
-20
-21
-22
-23
-24
-25
-26
SPIN RATE OF REAR SECTION
A
B
C
0
.1
.2
.3
.4
.5
.6
TIME

ELECTRO-MECHANICAL ROLL CONTROL APPARATUS AND METHOD

FIELD OF THE INVENTION

The present invention relates generally to a projectile, and more particularly to a projectile having two sections decoupled about a roll axis, a first section having a stator and the second section having a rotor and a static spin imparting member (e.g., fins), wherein the spin rate of the projectile is controlled by utilizing the rotor and stator in combination as a generator to brake the spin or as a motor to establish spin.

BACKGROUND ART

In the past, roll control devices for projectiles used either reaction jets and/or actuated aerodynamic surfaces. However, the use of such devices has presented several drawbacks. First, the devices generally included explosive elements or other high pressure devices. As those skilled in the art will appreciate, the use of explosives tends to disturb the projectile trajectory. Additionally, the use of propellant creates a limiting time factor to the control of the projectile, due to the predetermined burn time of the quantity of propellant stored on the projectile.

U.S. Pat. Nos. 4,568,039 and 4,438,893 disclose a guidance system for a spinning projectile. In the disclosed system the main housing spins and a front canard frame is despun. Two stator windings are disposed within the main housing and a cooperative pair of rotors are arranged within the canard frame. The first stator winding and rotor set generate power to provide control of the rotational position of the canard frame. The second stator winding and rotor set generates power for control of the deflectable canards. The disclosed device, however, includes several drawbacks. First, the device requires that the spin be imparted on the projectile by the launching device. By imparting the spin upon launch, the amount of energy available is limited and decreases over the duration of the flight. This is especially true while utilizing the spin for the purpose of despinning the front canard frame and generating power for the deflectable canards to steer the shell. In order to store the necessary energy a large rotational mass for the main housing must be used.

Therefore, there is a need for a new and improved roll control device which minimizes disturbance to the projectile trajectory, and provides on-demand, available torque for roll control during the entire projectile flight—for a variety of flight lengths.

SUMMARY OF THE INVENTION

The present invention provides an improved method and apparatus for roll control that overcomes the foregoing and other difficulties associated with the prior art. In accordance with the principles of the invention, there is provided an electro-mechanical roll control system ("EMRCS"), wherein a front (or first) section includes a stator and a rear (or second) section includes a rotor which is mounted in electromagnetic cooperation with the stator to form a motor. The first and second sections of the projectile are decoupled about the roll axis. The rear section of the projectile also includes a fixed torque application means to obtain a nominal steady state spin rate for the rear section. When the rear section spins, the electromagnetic interaction of the rotor and stator generates a control current which interacts with magnets cooperatively mounted in the rear section. A controller senses the interaction and provides control signals to adjust the rate of spin of the front section by applying a resistive load across the armature coil or by supplying current to the armature coil.

In a preferred embodiment of a device constructed according to the principles of the present invention, a front and rear section of the projectile are decoupled about the projectile longitudinal (or roll) axis using bearings or some other means for providing rotation between the front and rear sections while minimizing friction. When current is supplied to the armature coil, an equal and opposite force (i.e., a roll torque) is exerted on the projectile sections. These forces tend to accelerate the two sections in opposite directions. Folding fins on the rear of the projectile act as the fixed torque application means (e.g., the static spin imparting member), and are designed with cants or slight bevels. Therefore, when the projectile moves through the atmosphere, a relatively fixed torque is applied to the rear section, whereby a nominal steady-state spin rate for the rear section is established. Those skilled in the art will appreciate that the rate of travel of the projectile, as well as the density of the atmosphere (among other factors), affects the torque applied by the fins. Accordingly the torque is a nominal torque with a range about the nominal value.

When a control current is supplied to the armature coil, a torque balance is achieved between the two sections at a slightly perturbed spin rate. At this spin rate, a new level of a damping torque which matches the applied electromagnetic and fixed bevel torques is required. Active feedback is utilized to control the electromagnetic torque control.

To accelerate the front of the projectile to a spin rate away from the spin rate of the rear projectile, a battery is used to supply the current. To change the spin rate to a value closer to the rear projectile spin rate, a dynamic braking mode is used, in which the electro-mechanical system operates in a generator mode. In the latter mode, the current is preferably dumped to a resistive network. It will be appreciated by those skilled in the art that in the preferred embodiment described herein, the only aerodynamic roll torque acting on the front section is due to negligible surface drag. Thus, the front section accelerates as long as the torque is applied. One or more sensors mounted on the front section supplies a feedback signal for active damping of the control loop.

One feature of the present invention is that no electrical power is required in the rear projectile section. This eliminates any requirements for batteries or a power connection with the front section, thereby reducing weight and complexity.

An additional feature of the present invention is that the device provides control torque about a roll axis without disturbing the projectile trajectory. Therefore, a stabilized roll can be established on a missile or other projectile, as well as providing high-speed roll pointing control.

Another feature of the present invention is that during spin-up, de-spin and pointing maneuvers, the EMRCS can operate as a generator, potentially giving rise to lowered requirements for the power-up of front-end electronics and the use as a power source for the roll rate sensor—while the battery in the front section is being initiated and braking energy is generating power.

It will be appreciated by those skilled in the art that while the terms stator and rotor are used herein, such terms do not connote that either of the sections (in which such elements are located) are not spinning. To the contrary, each of the front and rear sections, with the stator and rotor attached thereto, may rotate since neither is fixed when the projectile is in flight. Those skilled in the art will also appreciate that while projectile spin provides for in-flight stability of the projectile and provides energy to accomplish in-flight pointing ability, it is often desireable or necessary for the front section of the projectile to spin at a lower rate (or to not spin) in order to provide for effective warhead detonation and explosion patterns.

Therefore, according to one aspect of the invention, there is provided a roll control apparatus for a projectile, comprising: a) a first section, said first section including a stator; and b) a second section including a rotor and a static spin imparting member operatively connected to said second section, wherein said two sections are rotatably connected about a longitudinal axis and wherein said rotor and stator are electro-mechanically connected to form an armature, wherein the spin rate of the projectile is controlled by utilizing the rotor and stator in combination as a generator to brake the spin or as a motor to establish spin.

According to another aspect of the invention, there is provided an electro-mechanical roll control system for a projectile, comprising: a) a front section including a stator having a coil; b) a rear section including a rotor which is mounted in electromagnetic cooperation with said stator, wherein said first and second sections are rotatably connected to one another about a longitudinal axis and wherein each of said first and second sections are rotatable about said longitudinal axis; c) a fixed torque application means, cooperatively connected on the exterior of said rear section, for applying a force to said rear section, whereby a nominal steady state spin rate for the rear section is established, and wherein when said rear section spins, then the electromagnetic interaction of said rotor and said stator generates a control current; d) one or more sensors, cooperatively located in said front section, for sensing said control current and generating an input signal; and e) a controller for receiving said input signal, determining the actual spin rate of said front section, comparing said actual spin rate with a predetermined target rate, and for generating a control signal to adjust the rate of spin by applying a resistive load across the armature coil or by supplying current to the armature coil.

These and other advantages and features which characterize the present invention are pointed out with particularity in the claims annexed hereto and forming a further part hereof. However, for a better understanding of the invention, its advantages and objectives obtained by its use, reference should be made to the Drawings which forms a further part hereof and to the accompanying descriptive matter, in which there is illustrated and described a preferred and an alternative embodiment of the present invention.

BRIEF DESCRIPTION OF THE DRAWINGS

Referring to the Drawings wherein like parts are referenced by like numerals throughout the several views.

FIG. 3 is an enlarged section of a portion of the projectile 30 of FIG. 1;

FIGS. 4*a* and 4*b* are views of the fin(s) 44 illustrating the cant and/or bevel of the fins 44 of projectile 30;

FIG. 7 is an illustrative response curve of the electro-mechanical roll control apparatus and method, plotted as a function of the spin rate of the rear section versus time during a despinning operation of the front section; and FIG. 8 is an alternative embodiment electro-mechanical roll control apparatus and method wherein the front section includes oppositely directed spin imparting members to provide for generation of power for the entire flight.

DETAILED DESCRIPTION

The principles of this invention apply particularly well to controlling roll in a projectile or other missile. A preferred application for this invention is in a projectile device fired from or at a tank type vehicle. Such preferred application, however, is typical of only one of the innumerable types of applications in which the principles of the present invention can be employed. Since the EMRCS replaces previously used reaction jet torque control systems, it will be appreciated that many of the same general requirements are desirable. For example the reliability, maintainability, safety, temperature environment, gun hardening, etc. are preferably considered.

As will also be appreciated by those skilled in the art, in order to apply a roll torque to a projectile using an electro-mechanical device, a multiple-part body may be used. In order to more clearly describe the present invention, the detailed descriptions of the theoretical operation, the elements utilized in the preferred embodiment, and the temporal events which occur during operation will be deferred pending a discussion of a projectile in which the present invention may be employed. After a discussion of such a projectile, each of the other three topics will be discussed in turn.

PROJECTILE 30

Figure 1:
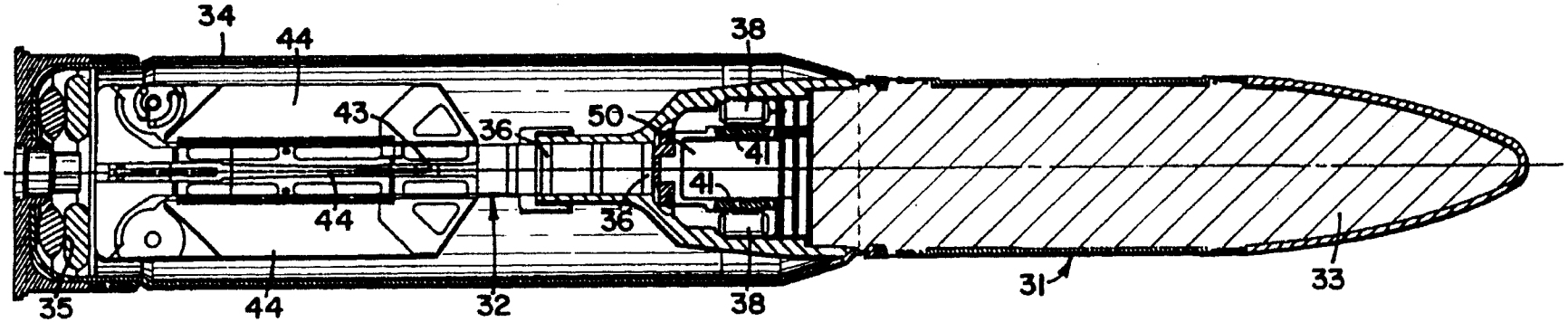
FIG. 1 is a side elevational view (with portions taken in cross section) of a projectile 30 in which the electro-mechanical roll control apparatus and method constructed according to the principles of the present invention might be employed.
Figure 2:
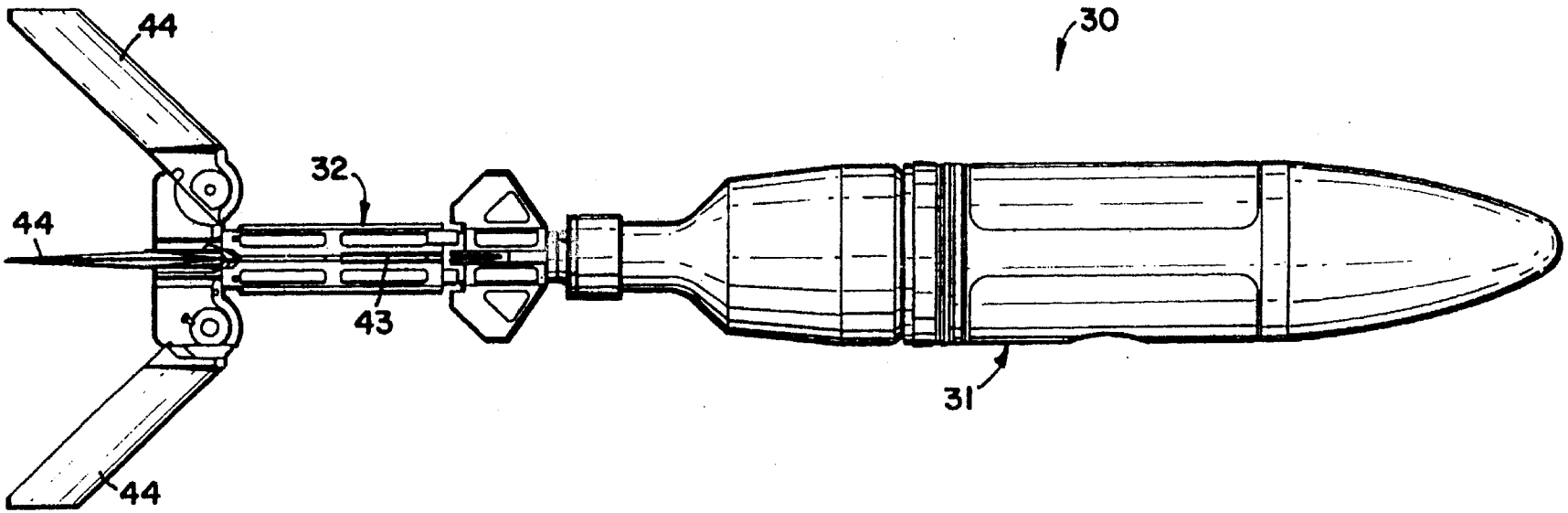
FIG. 2 is a side plan view of the projectile 30 of FIG. 1 illustrating deployment of the fins 44 after the projectile 30 is in flight.

Referring first to FIGS. 1, 2, 3 and 4*a* and 4*b*, there is illustrated a projectile, referred to generally by the designation 30, in which a preferred embodiment electro-mechanical roll control apparatus and method may be utilized. The front section 31 (i.e., the forward section of the projectile 30 body) contains a payload section 33 (in which certain electronics devices may also reside), various electronics devices (discussed below in connection with FIG. 5), and power supply/battery 50 (discussed in more detail below). Also illustrated in FIG. 1 is the projectile case 34, the material 35 which propels the projectile 30 from the launching device (not shown), and bearings 36.

Figure 5:
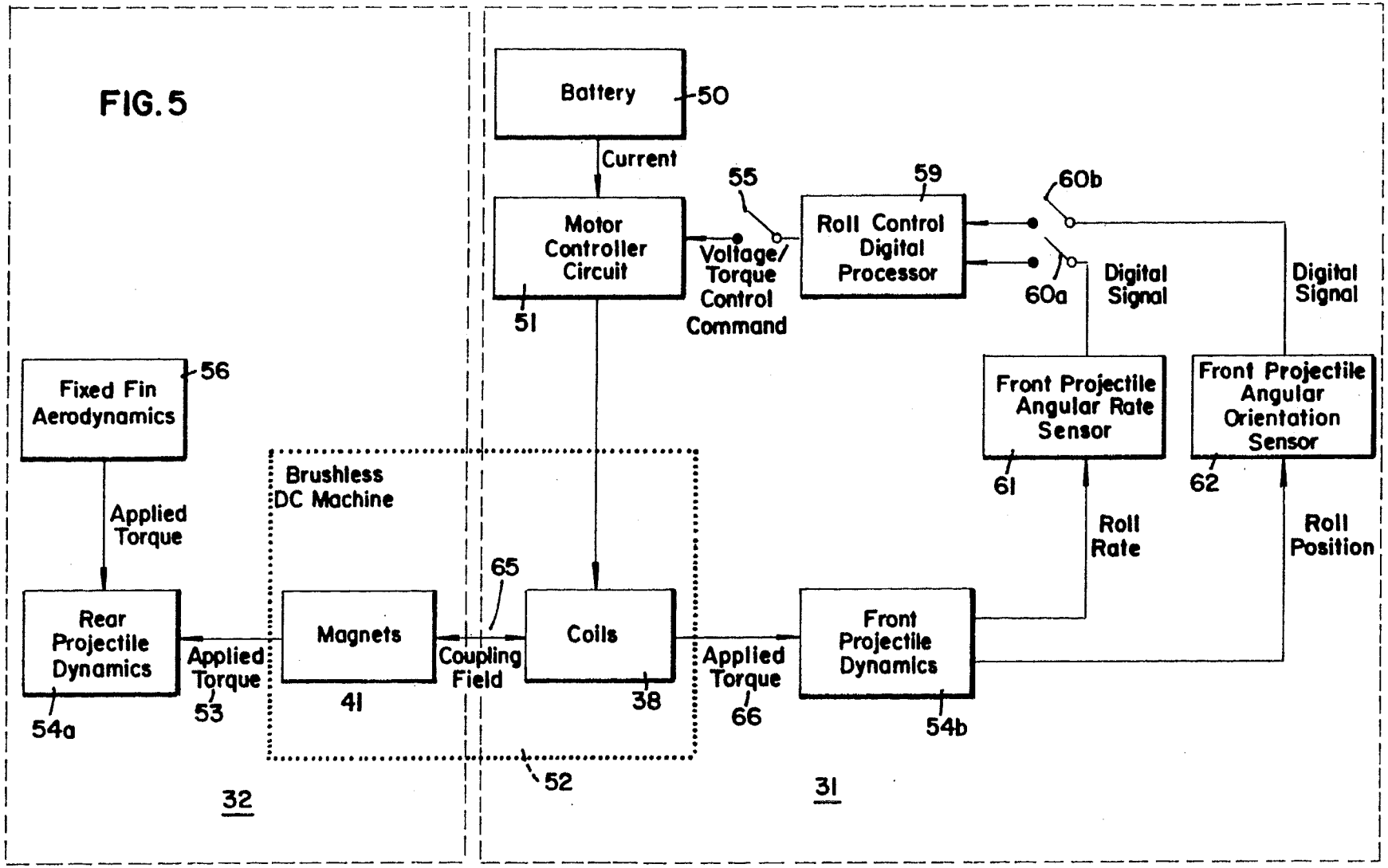
FIG. 5 is a functional block diagram of the various torsion and electro-mechanical elements of the projectile 30 and including the components of an electro-mechanical roll control apparatus and method constructed in accordance with the principles of the present invention.

The front section 31 further includes the coils 38 for the armature of the control device brushless DC machine 52 (best seen in FIG. 5). The magnets 41 of the armature are connected to the rear section 32 (i.e., the aft section of the projectile 30 body) and are preferably permanent magnets.

Tail boom 43 extends from a first end proximate the front section 31 to a second end which is at the aft end of the projectile 30. At the second end, fold-out fins 44 are hingedly attached and are biased into a flight position after the projectile 30 is in flight (best seen in FIG. 2). The fins 44 provide flight stability for projectile 30 and operate as the fixed torque application means (i.e., also the static spin imparting member).

Referring now to FIGS. 4*a* and 4*b*, views of the fins 44 which illustrate the bevel 40 (FIG. 4*a*) and cant (FIG. 4*b*) of the fins 44 is provided. For the purpose of clarity, a cant will be discussed herein, however, a bevel might also be used. Each fin 44 is similarly canted in order to apply a torque as the projectile 30 moves through the atmosphere. It will be appreciated that the greater the cant, the larger the torque which will be generated. In the preferred embodiment, in view of the speed of the projectile, only a fraction of a degree θ of cant is required to impart the necessary torque and, therefore, the necessary spin.

The approximate spin rate of the preferred embodiment is in the 20 Hz range, however, other frequency/speeds might be used as those skilled in the art will appreciate. In view of the various masses and the projectile speed, among other factors, the cant or bevel of the fin must generally be found empirically for the specific projectile on which the present invention will be utilized. In the preferred embodiment, the fins are canted or beveled in order to establish a clockwise rotation as viewed looking along the projectile flight path from the rear to the front.

THEORY OF OPERATION

Figure 6A:
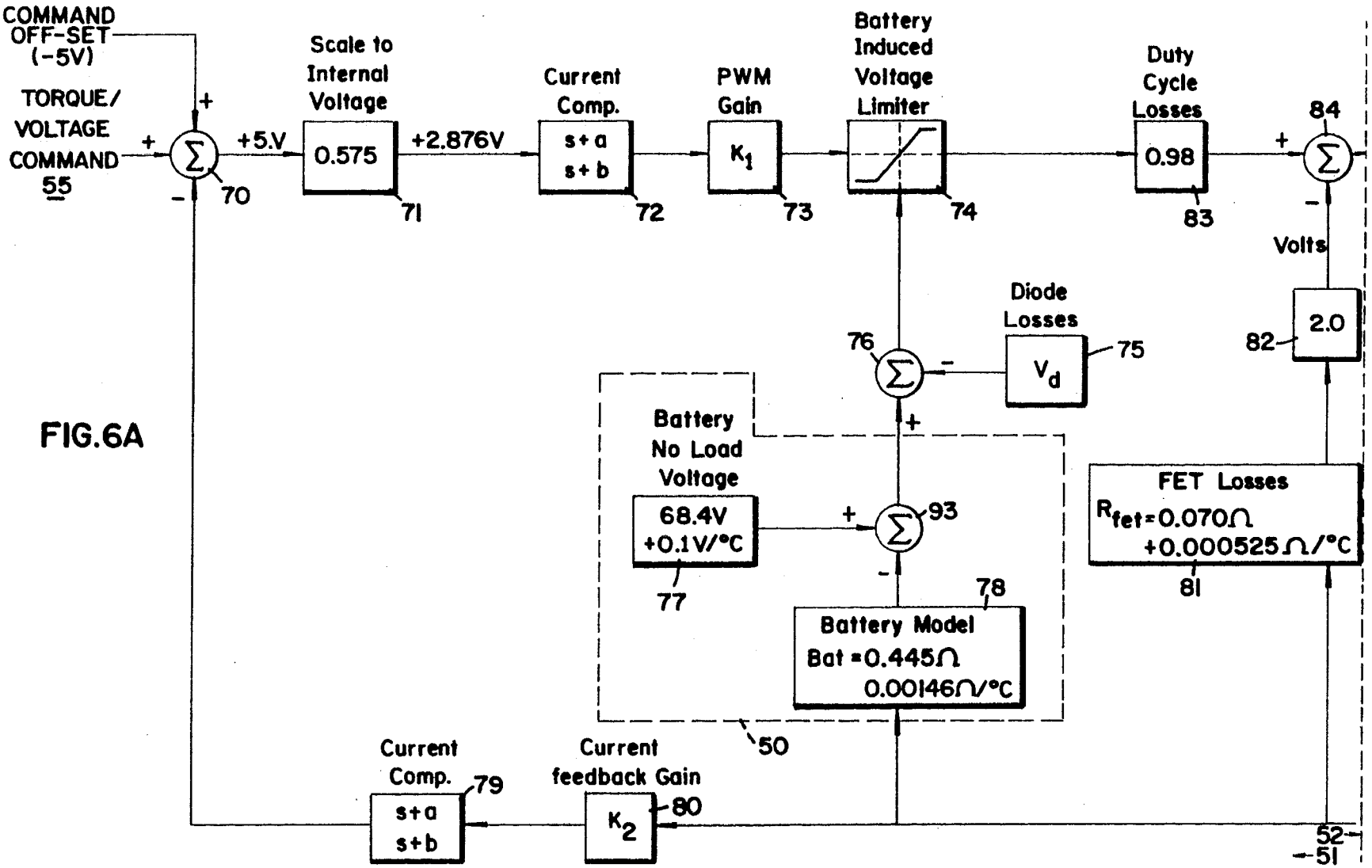
FIG. 6 is a block diagram illustrating in greater detail the electro-mechanical elements of FIG. 5.
Figure 6B:
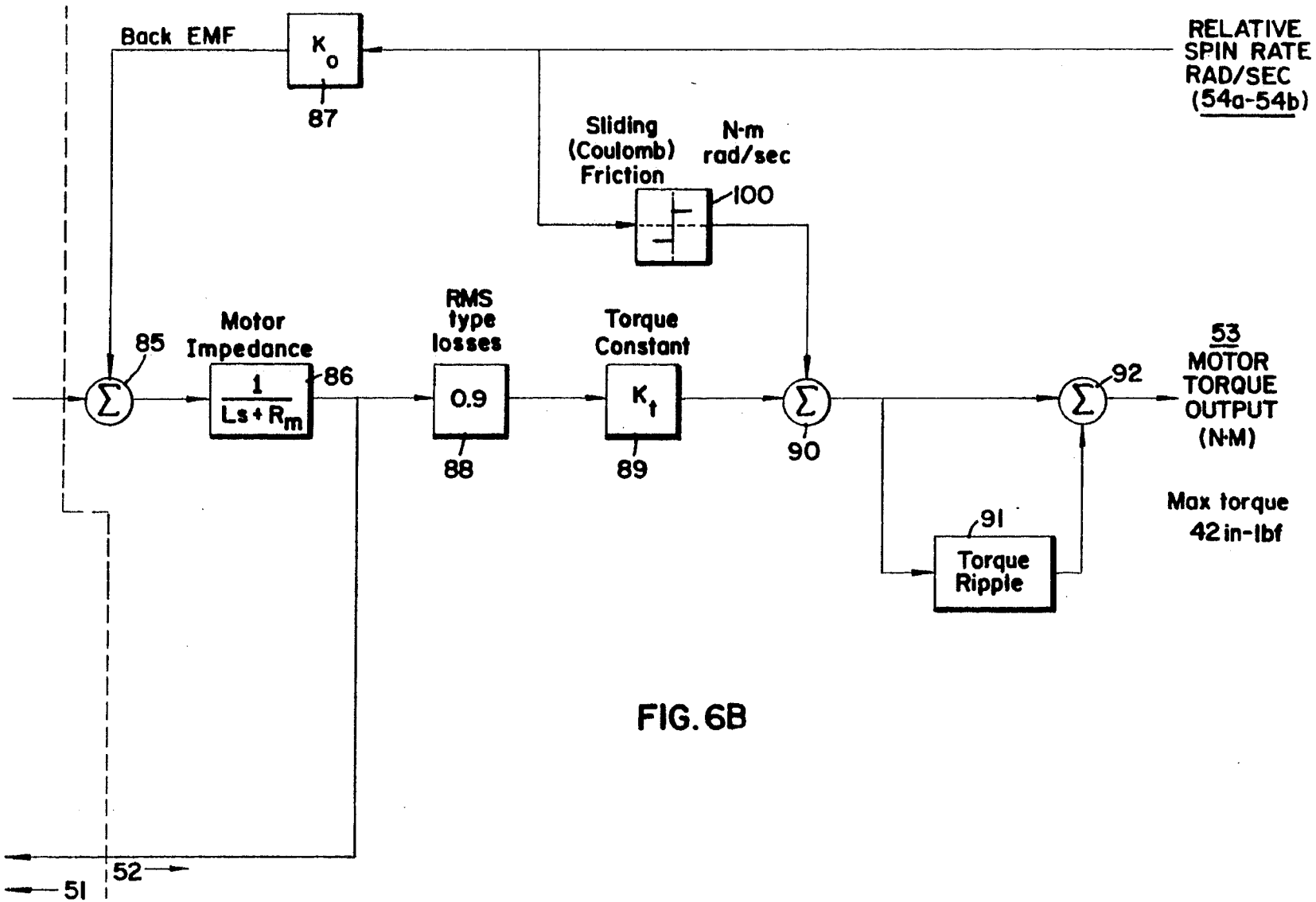

Although discussed in more detail below, FIG. 5 depicts a functional block diagram schematic of an EMRCS suitable for embodying the principles of the present invention, while FIG. 6 is a block diagram schematic of typical hardware interfaces suitable for implementing the functions of the embodiment of FIG. 5. As noted above, the EMRCS may be disposed onboard a projectile 30 and be operative during the flight of the projectile 30 in order to orientate the front section 31 of the projectile 30 to point in a desired orientation about the projectile roll axis.

As illustrated in FIG. 5, the projectile is divided into front and rear sections or assemblies 31 and 32. Equal and opposite torques can be applied to the sections via the coupling field established between the coils 38 and magnets 41 of the preferred brushless DC machine 52. The torques acting on the rear section 32 about the roll axis are due primarily to the four sources set forth in Table 1.

TABLE 1

1. The coupling field of the DC machine;
2. The aerodynamic damping torque imparted on the rear body by the fixed fins;
3. The aerodynamic torque due to the cant or beveling of the fixed fins; and
4. Friction on the bearing surfaces between the front and rear projectile sections.

Those skilled in the art will appreciate that the torque due to the electromechanical system is proportional to the current, i, flowing in the coils 38, that is:

$$T_e=K_T i$$

where $K_T$ is the torque constant of the brushless DC machine 52.

The aerodynamic damping torque is proportional to the spin rate of the rear section 32 relative to the surrounding air:

$$T_d=(\bar{q}Sd^2/2V)C_{1p}p_r$$

where:

$p_r$ is the spin rate of the rear projectile body, d is the projectile reference diameter, $\bar{q}$ is the dynamic pressure, S is the projectile reference cross-sectional area, V is the forward velocity of the projectile, and $C_{1p}$ is the dimensionless roll damping coefficient.

The aerodynamic torque due to the cant or beveling of the fixed fins 44 is given by:

$$T_b=\bar{q}SdC_1$$

where $C_1$ is the aerodynamic roll moment coefficient of the rear section/assembly 32. The total torque acting on the rear projectile is:

$$T_r=T_e+T_d+T_b+T_f$$

where $T_f$ is the frictional torque.

When no current is applied to the coils 38 the rear section 32 spin rate will tend towards a value given by:

$$R_r=2V((\bar{q}SdC_1+T_f)/\bar{q}Sd^2C_{1p}$$

When current is applied to the motor coils 38, the rear section 32 will accelerate according to:

$$\Phi=(K_T i+(\bar{q}Sd^2/2V)C_{1p}p+\bar{q}SdC_1+T_f)/I_r$$

where $I_r$ is the roll moment of inertia of the rear section 32.

When a fixed torque is applied to the rear section 32, the spin rate of the rear section 32 tends towards a spin rate Δp away from the equilibrium spin rate p, given above. The deviation of the spin rate from equilibrium is given by:

$$\Delta p=(2VK_T i/\bar{q}Sd^2C_{1p})$$

Besides providing the required stability to the projectile, the fin design must result in values of $C_{1p}$ and $C_1$ such that $p_r$ is at an acceptable value bounded away from the projectile 30 resonant frequency throughout the flight regime and that $p_r \pm \Delta p$ is an acceptably small range for the applied torques required for controlling the roll rate and roll orientation of the front section 31.

EMRCS FUNCTIONAL BLOCKS

In general, in the preferred embodiment, the input signal to the drive electronics is an analog signal proportional to the desired torque. The controller utilizes current feedback control to ensure that the torque is developed. Even though the motor only rotates in one direction, both positive (accelerating) and negative (braking) torques are controlled. It will be appreciated that during the braking mode, the motor acts equivalent to a generator, and a resistive load must be provided to dissipate the energy. Protection circuitry is also preferably provided in order to prevent recharging the battery.

In the preferred embodiment, there is driver board in the front section 31 which converts a digital signal in the digital processor block 59 into a current drive for the motor controller circuit block 51. The block 59 also includes proper digital to analog and analog to digital convertors.

More specifically, FIGS. 5 and 6 illustrate the various electrical functional blocks and logical data flow of the projectile and EMRCS. While not specifically detailed in FIGS. 5 and 6, it will be understood that the functional blocks, and other devices are properly connected to appropriate bias and reference supplies so as to operate in their intended manner. Further, appropriate memory, buffer, timing and other attendant peripheral devices are to be properly connected for the devices to operate as intended.

Referring first to FIG. 5, there is illustrated the various components, in functional block form, of the rear section 32 and the front section 31. In the rear section 32, the fixed fin aerodynamics block 56 applies a torque to the rear projectile dynamics block 54*a*. It will be appreciated that the rear projectile dynamics block 54*a* includes all of the net forces (i.e., as discussed above in Table 1). The applied torque 53 from the rear projectile dynamics block 54*a* is applied to the front section 31 via magnets 41 of the armature of the motor (preferably a brushless DC machine 52) to the coils 38. As utilized herein, the term brushless DC machine 52 is used to emphasize that an electromagnetic device is used in both a generator and alternator mode. It will be appreciated that an electromagnetic coupling exists between the magnets 41 and the coils 38. The coupling field is generally designated by the numeral 65.

As noted above, the front section 31 includes coils 38 as part of the armature of the brushless DC machine 52. The applied torque designated by the numeral 66 is provided to the front projectile dynamics block 54*b*. Similar to the rear projectile dynamics block 54*a*, the front projectile dynamics block 54*b* is illustrative of the net forces on the front section 31 of the projectile 30.

The resulting physical parameters are measured by the front projectile angular rate sensor block 61 (e.g., to measure the roll rate) and a front projectile angular orientation sensor block 62 (e.g., to measure the roll position). It will be well understood by those skilled in the art that these sensors may comprise various gyros, radars, lasers, etc. The sensor blocks 61 and 62 provide digital signals, via switches 60*a* and 60*b* respectively, to a roll control digital processor block 59. This functional block provides a command signal to the motor controller circuit 51 to provide appropriate feedback control loop signals to stabilize the projectile 30. Those skilled in the art will appreciate that such feedback control loops are well known in the art and may include proportional, integral and derivative components (or combinations thereof), fuzzy logic, and other types of control process algorithms.

Voltage/torque control command switch 55 is interposed between the motor control circuit 51 and the roll control digital processor 59. Motor controller circuits are also well known in the art and so will not be described in detail herein. Battery 50 provides the necessary power to the motor controller circuit block 51 when operating the brushless DC machine 52 as a motor. The motor controller circuit 51 also includes a resistive network for dumping current from the coils 38 when the brushless DC machine 52 is operating as a generator.

Turning now to FIG. 6, there is illustrated in more detail blocks 50, 51, and 52 of FIG. 5. First, the voltage command signal 55 is summed at block 70 with a command voltage offset and the output from current compensation block 79. The resulting signal is provided to a scaling block 71 and from there is provided to current compensation block 72. The signal from current compensation block 72 is stepped up at pulse width modulator gain block 73 and is provided to battery induced voltage limiter block 74.

Battery 50 includes a battery model block 78, battery no load voltage block 77, and summing block 93. The output of the summing block 93 is in turn summed with diode losses block 75 at summing block 76. The diode losses block 75 diodes are utilized for circuit protection during use of the resistive network during generator operation. The output of summing block 76 is also provided to the battery induced voltage limiter 74. Duty cycle losses block 83 provides the voltage limited signal to summation block 84. The motor controller block 51 further includes transistor losses block 81 and gain block 82 which is summed at summation block 84.

The various elements of the brushless DC machine 52 include summation block 85 which provides a signal to the motor impedance block 86, the output of which includes the controlled current (for current feedback gain block 80 and current compensation 79 block). Additionally, the output of the motor impedance block 86 is provided to the RMS type losses block 88. This signal is multiplied by the torque constant $K_t$ of the brushless DC machine 52 and is summed at summation block 90.

The relative spin rate (in radians per second) is provided as an input signal to the voltage constant $K_e$ at block 87. The resulting back EMF signal is provided to summation block 85. The relative spin rate signal is provided to sliding friction block 100 which decreases the output summed at block 90 discussed above. Torque ripple block 91 is subtracted from the output at summation block 92 and provided as a motor torque output signal 53.

For proper control responses for a projectile fired from a 120 mm gun the required torque is in the range of ± 30 in.-lb. and shaft power of approximately 3 bursts of 500–600 watts for 0.1 second durations (needed for de-spin, vertical orientation and terminal pointing).

As noted above, during spin-up and during the braking portion of each pointing maneuver, the brushless DC machine 52 acts as a generator. During spin-up, the power generated may be used for warm-up and initialization of front-end electronics. Also as noted above, it will be appreciated that the protection circuitry and resistive loads must be established such that excess power generated during braking does not recharge and destroy the thermal battery 50. It is currently believed by the inventors that the motor ripple torque at amplitudes of 100% will not impact the response and accuracy of the control system as long as the frequency is three times the roll rate of the rear section 32.

In the preferred embodiment, the EMRCS weighs approximately 16½ lbs. and preferably has a volume of less than 300 cubic inches. The available volume and size of the housing for the EMRCS is driven by the thickness of the housing required to withstand a 21,000 g setback load. This has been determined to be approximately 0.4 inch. In the preferred embodiment, the boom is a solid aluminum boom having a diameter of 1.4 inches. Other style booms such as a cursor form shaped boom might also be used.

The bearings 36 are designed to withstand the friction generated by the system. In the preferred embodiment roller bearings are utilized. A seal is provided to protect the electronics from gases generated when firing the projectile. In the preferred embodiment, the seal includes a grooved washer.

IN OPERATION

Turning now to the operation of the EMRCS, Table 2 illustrates a listing of the temporal events which occur during the flight of projectile 30.

TABLE 2

Time Line of Temporal Events

1. Projectile is fired from gun.
2. The onboard thermal battery 50 is initiated.
3. The tail fins 44 on the rear projectile section 32 are deployed into the airstream.
4. The rear section 32 spins up to the equilibrium roll rate.
5. The system power level comes up and the motor controller 51 is operable.
6. Either clockwise or counter-clockwise torques are applied about the projectile roll axis by supplying the corresponding command 55 to the motor controller circuit block 51.
7. Angular rate sensor 61 and position sensor 62 which are mounted on the front section 31 continuously supply measurement data to a roll control digital processor 59 which, in turn, commands the motor controller circuit block 51 with the desired feedback torque.

FIG. 7 illustrates a simulation of the response of the control system. First, the inertial rotation of the rear section 31 is illustrated as ramping up very quickly and at area designated by the letter A decreases. This decrease corresponds to a command to speed up the front section 31. At the section of the curve designated by the letter B, the spin rate of the rear section decreases further as the front section 31 spin rate is slowed. A second overshoot to settle the front section is illustrated at the section designated by the letter C. Thereafter, a steady state nominal spin rate is achieved. It will be appreciated by those skilled in the art that the curve illustrated in FIG. 7 is illustrative only and is provided herein for the purpose of depicting the temporal sequence of events which occurs when applying a step command to the front section.

ALTERNATIVE EMBODIMENT

Next referring to FIG. 8, an alternative embodiment is illustrated. The alternative embodiment includes fins 110 on the front end 31' of the projectile 30' to cause the drive to operate as a generator for the duration of the flight. It will be appreciated that this can completely eliminate the need for thermal batteries on board the projectile 30', thereby reducing cost and increasing reliability.

Those skilled in the art will appreciate, when the electric drive is in the braking mode (i.e. the mode in which it generates power) it produces a clockwise torque on the front end 31' of the projectile 30'. If a net torque of ±30 in.-lb. is desired for control purposes, then additional torque to generate more power must be delivered. Assuming that electrical power requirement of 10 amps and 30 volts is required for the duration of the flight to power the front end 31', the motor is 80% efficient, and the fins 44' on the rear section 32' provide a steady state nominal spin rate of 20 Hz, then a torque of 26 in.-lb. is required to generate the electrical power.

Accordingly, the fins 110 on the forward section 31' of the projectile 30' have to be sized to produce a counter-clockwise torque of 56 in.-lbs. The fins 110 on the forward section would be sized by the minimum dynamic pressure condition. Motor torque at this condition would vary from 26 to 86 in.-lbs. in order to produce the desired net torque of ±30 in.-lbs. for control purposes. For the maximum dynamic pressure condition, the torque produced by the forward fins 110 would increase by about a factor of 2 (e.g., a counter-clockwise torque of 122 in.-lbs.). Under this maximum dynamic pressure condition, the motor must produce a torque of 82 in.-lbs. to 142 in.-lbs. Accordingly, the peak torque of the motor would range from 26 to 142 in.-lbs. instead of the ±30 in.-lbs. required in a system which makes use of thermal batteries. The fins 110 on the forward end 31' would have a total area of roughly 4 square inches. Drag on the projectile would be increased by roughly 1%.

Other alternative designs for the EMRCS are possible. For example, the permanent magnets for the motor may be mounted on the outside of the coils. This is commonly known as an inverted motor design. With this design, the magnets are mounted on the inside of the housing and the entire housing rotates with the rear end of the projectile. However, it is believed that a design with the permanent magnets mounted on the inside shaft is preferable. Most motors utilize this configuration because of the reduced motor inertia. In both implementations, however, the magnets rotate with the rear section, thereby eliminating any need for slip rings and electrical power in the rear end of the projectile.

A configuration with the magnets on the inside is preferred for several other reasons as well. First, it appears that smaller seal is easier to construct robustly, and the smaller bearings required are lighter and less costly. Additionally, magnets constructed of samarium cobalt do not lose their magnetism when shocked. However, those skilled in the art will appreciate that care must be taken to assure the material stays in compression, as it readily fails mechanically when in tension.

It is to be understood that even though numerous characteristics and advantages of the present invention have been set forth in the foregoing description, together with details of the structure and function of the invention, this disclosure is illustrative only and changes may be made in detail, and to the full extent indicated by the broad general meaning of the terms in which the appended claims are expressed.

What is claimed is:

1. A roll control apparatus for a projectile, comprising:

a) a first section, said first section including a stator;

b) a second section including a rotor and a static spin imparting member which imparts rotation of the second section in flight, wherein said two sections are rotatably connected about a longitudinal axis and wherein said rotor and stator are electro-mechanically connected to form an armature; and c) a controller, coupled to the armature, for controlling the spin rate of the projectile, the controller including means for selectively providing a current to the armature to operate the armature as a motor and thereby apply a torque in one direction, and means for selectively coupling the armature to a resistive load to operate the armature as a generator and thereby apply a torque in an opposite direction.

2. The apparatus of claim 1, wherein said static spin imparting member is a plurality of fins.

3. The apparatus of claim 2, wherein said plurality of fins includes four fins extending generally radially from said longitudinal axis.

4. The apparatus of claim 2, wherein said fins are beveled and wherein said fins taper from the rear toward the front of the projectile.

5. The apparatus of claim 2, wherein said fins are canted in a cooperative manner with one another to spin said second section of the projectile as the projectile moves through the atmosphere.

6. The apparatus of claim 2, further comprising a second spin imparting member arranged and configured on said first section to spin said first section as the projectile moves through the atmosphere, wherein energy for said controller is generated, and whereby batteries may be reduced or eliminated.

7. The apparatus of claim 1, wherein said static spin imparting member includes four fins extending generally radially from said longitudinal axis, wherein said fins are canted in a cooperative manner with one another to spin said second section of the projectile as the projectile moves through the atmosphere, and further comprising a second spin imparting member arranged and configured on said first section to spin said first section as the projectile moves through the atmosphere, wherein energy for said controller is generated, and whereby batteries may be reduced or eliminated.

8. The apparatus of claim 1, wherein said armature is a brushless DC machine and said stator includes windings.

9. An electro-mechanical roll control system for a projectile, comprising:

a) a front section including a stator having an armature coil;

b) a rear section including a rotor which is mounted in electromagnetic cooperation with said stator, wherein said front and rear sections are rotatably connected to one another about a longitudinal axis and wherein each of said front and rear sections are rotatable about said longitudinal axis;

c) a fixed torque application means, cooperatively connected on the exterior of said rear section, for applying a force to said rear section, whereby a nominal steady state spin rate for the rear section is established, and wherein when said rear section spins, then the electromagnetic interaction of said rotor and said stator generates a control current;

d) one or more sensors, cooperatively located in said front section, for sensing said control current and generating an input signal; and e) a controller for receiving said input signal, determining the actual spin rate of said front section, comparing said actual spin rate with a predetermined target rate, and for generating a control signal to adjust the rate of spin by selectively applying a resistive load across the armature coil and by selectively supplying current to the armature coil.

10. The apparatus of claim 9, wherein said fixed torque application means is a plurality of fins.

11. The apparatus of claim 10, wherein said plurality of fins includes four fins extending generally radially from said longitudinal axis.

12. The apparatus of claim 10, wherein said fins are beveled and wherein said fins taper from the rear toward the front of the projectile.

13. The apparatus of claim 10, wherein said fins are canted in a cooperative manner with one another to spin said rear section of the projectile as the projectile moves through the atmosphere.

14. The apparatus of claim 10, further comprising a spin imparting member arranged and configured on said front section to spin said front section as the projectile moves through the atmosphere, wherein energy for said controller is generated, and whereby batteries may be reduced or eliminated.

15. The apparatus of claim 10, wherein said plurality of fins includes four fins extending generally radially from said longitudinal axis, wherein said fins are canted in a cooperative manner with one another to spin said rear section of the projectile as the projectile moves through the atmosphere, and further comprising a spin imparting member arranged and configured on said front section to spin said front section as the projectile moves through the atmosphere, wherein energy for said controller is generated, and whereby batteries may be reduced or eliminated.

16. A method for controlling the roll of a projectile having a front and rear section which are decoupled from one another about the roll axis through a rotor and a stator operatively connected to one another to form an armature, the method comprising the steps of:

a) deploying tail fins on the rear section to spin the rear section as the projectile moves through the atmosphere;

b) allowing the rear section to spin up to an equilibrium roll rate;

c) selectively applying a torque to the projectile roll axis in a first direction by supplying current to the armature;

d) selectively applying a torque to the projectile roll axis in a second direction by coupling the armature to a resistive network; and e) continuously measuring an angular roll rate and a position of the front section of the projectile, comparing the measured information to at least one target value, determining an error signal, and controlling the application of torque in the first and second directions in steps c) and d) to stabilize the roll of the front section.

17. The method of claim 16, wherein said deploying step occurs after firing the projectile from a launching device.

18. The method of claim 16, further comprising the step of providing said front section with oppositely disposed spin imparting members to generate additional torque, wherein said armature produces power for a longer portion of the projectile flight.

19. The method of claim 18, wherein said spin imparting members on said front section are fins which are arranged and configured to be unitary with said front section.

* * * * *